United States Patent [19]

Takefman

[11] Patent Number: 4,569,086

[45] Date of Patent: Feb. 11, 1986

[54] INFANT BIB

[75] Inventor: Earl Takefman, Montreal, Canada

[73] Assignee: Charan Industries Inc, Montreal, Canada

[21] Appl. No.: 736,081

[22] Filed: May 20, 1985

[51] Int. Cl.[4] ..... A41B 13/10

[52] U.S. Cl. ..... 2/49 R

[58] Field of Search ..... 2/49 R, 48, 49 A

[56] References Cited

U.S. PATENT DOCUMENTS

| | | | |
|---|---|---|---|
| 879,124 | 2/1908 | Thompson | 2/49 R |
| 996,084 | 7/1911 | Herring | 2/49 R |
| 1,391,121 | 9/1921 | Keppel | 2/49 R |
| 2,643,384 | 6/1953 | Thompson | 2/49 |
| 3,597,763 | 11/1971 | Bienvenu | 2/49 |
| 3,984,876 | 8/1976 | Sutton | 2/49 |
| 4,301,544 | 11/1981 | Burton | 2/49 A |

*Primary Examiner*—Doris L. Troutman

*Attorney, Agent, or Firm*—Robic, Robic & Associates

[57] ABSTRACT

An infant feeding bib which is comfortable to wear and efficient in use. The bib comprises an apron-like member made of flexible material, which member is attachable to the neck of the infant to be fed, and a trough-shaped member made of rigid or substantially rigid material, which member is detachably connected to the apron-like member for catching the solids and liquids inadvertantly dropped by the infant.

6 Claims, 3 Drawing Figures

INFANT BIB

BACKGROUND OF THE INVENTION

1. Field of the invention

The present invention relates to an improved, infant feeding bib.

More particularly, the invention relates to an improved feeding bib which is made of two parts of different rigidities, making it both confortable to wear and efficient in use for catching food solids and liquids dropped by the infant.

2. Brief description of the prior art

Most of the infant bibs presently available in the market for use by mothers having to fed very young kids are of two different types.

The bibs of the first type which is beyong any doubt the oldest one, consist of small aprons made of soft fabric or, more generally, flexible plastic material. The upper edge of the apron is usually shaped to fit the neck of the infant to be fed. Fixation means generally consisting of a pair of straps to be knotted or, more recently, of a band integrally extending the upper edge of the apron on one side of the neck of the infant and passing behind this neck for connection onto the apron on the other side of the neck of the infant, using a VELCRO or a snap-fastener.

This well known bib is easy to use and confortable to wear. However, it has the drawback of not preventing liquids or solids refused or rejected by the infant from dropping down.

To obviate this well known probelm, it has been suggested to fold back upwardly the upper edge of the apron to form a pocket for catching the liquids and solids dropped by the infant. This solution which is commonly used by the bibs' manufacturers is a good one but has a drawback too, in that the pocket which is made of the same flexible material as the apron is seldomy sufficiently opened to be efficient, especially when the infant to be fed is wriggling.

To obviate this other drawback, it has been suggested in U.S. Pat. No. 2,643,384 issued on June 30, 1953 to Henri Thompson, to use fasteners for rigidly connecting the upper edge of the front wall of the pocket to a protective panel itself connectable to a table by means of suction cups. This particular solution may be efficient but has the major drawback of lacking simplicity.

The bibs of the other type that are commonly available in the market, consist in small aprons made of very rigid material and formed with an integral, rigid trough extending along their bottom edges to catch anything dropped by the infant. This type of rigid bibs which is available almost everywhere, is very efficient as far as catching of foods and liquids dropped by the infant is concerned. This type of rigid bibs however has the major drawback of being very inconfortable to wear the rigid neck portion of the apron being often hurting, especially when the means used for fixing the bib are made of the same rigid material as the apron itself.

SUMMARY OF THE INVENTION

An object of the present invention is to provide an infant feeding bib which overcomes the drawbacks of both types of bibs presently known to the public.

More particularly, the object of the invention is to provide an infant feeding bib which is made of two parts of different rigidities, the upper part which is intended to be fixed to a neck of the infant being made of flexible material to make the bib confortable to wear whereas the lower part of the bib is made of rigid material and provided with a trough capable of catching any solids or liquids dropped by the infant.

In accordance with the invention, this particular object is achieved with an infant feeding bib comprising:

- an apron-like member made of flexible material preferably a soft plastic material, which apron-like member has an upper edge shaped to fit the neck of an infant to be fed, and a lower edge;
- means on the upper end of the apron-like member for detachably connecting this apron-like member to the neck of the infant to be fed;
- a trough-shaped member made of a rigid or substantially rigid material, said trough-shaped member having an upper edge which is substantially flat and a lower edge which is bent forwardly and upwardly to define a trough for catching solids and liquids dropped by the infant; and
- means for fixing the upper edge of the rigid trough-shaped member to the lower edge of the flexible apron-like member so that the rigid trough-shaped member extends downwardly the flexible apron-like member in cooperative relationship therewith.

According to a preferred embodiment of the invention, the upper edge of the trough-shaped member is substantially of the same length as a lower edge of the apron-like member to which it is fixed and the means for fixing the upper edge of this trough-shaped member to the lower edge of this apron-like member are of the detachable type. This particular embodiment makes the infant bib according to the invention easy to handle and to clean. Moreover, this particular embodiment makes it possible to use alone the upper, apron-like member made of flexible material, when the infant becomes cleaner and it becomes unnecessary to use the trough-shaped member.

As can be easily understood, the apron-like member of the infant bib according to the invention can be detachably connected to the neck of the infant by any suitable means. By way of example, the apron-like member may be connected to the neck of the infant by means of a pair of knottable straps attached to the upper edge of the member on both sides of the neck of the infant. Alternatively, the apron-like member may be connected to the neck of the infant by means of a strap fixed onto the apron on one side of the neck of the infant this strap being long enough to pass around the infant's neck so that it is be connected to the other side of the neck of the infant with a VELCRO (trade mark) or snap-fastener.

In practice, the apron-like member and the trough-shaped member may be connected to each other by any suitable means, such as, for example, snap-fasteners or VELCRO-fasteners.

BRIEF DESCRIPTION OF THE DRAWINGS

A preferred embodiment of the invention will now be described in a non limitative manner with reference to the accompanying drawings, wherein.

DESCRIPTION OF A PREFERRED EMBODIMENT

Figure 1:
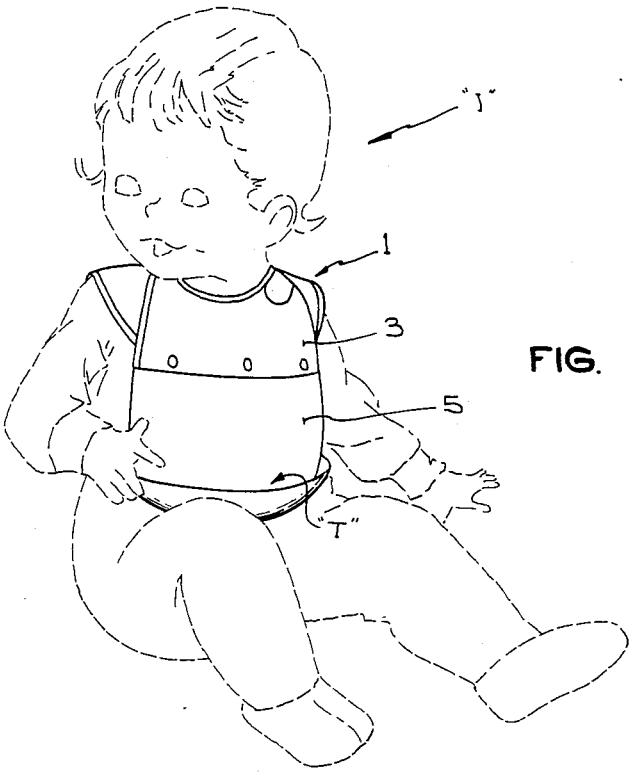
FIG. 1 is a general view of an infant wearing a feeding bib according to the invention.
Figure 3:
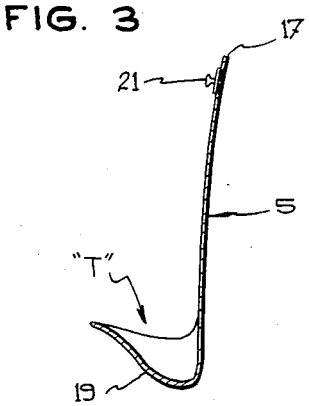
FIG. 3 is a side elevational, cross-sectional view of the trough-shaped member of the bib shown in FIGS. 1 and 2.

The bib 1 shown in the accompanying drawings is intended to be used for feeding an infant I.

This bib 1 comprises an apron-like member 3 having an upper edge 7 shaped to fit the neck of the infant to be fed, and a lower, rectilinear edge 9. The apron-like member 3 also comprises a pair of shoulders covering wings 11 and 11' and an integral strap 13 extending from the apron-like member 3 on one side of the neck of the infant to surround this neck. The strap 13 is sized to be long enough to pass behind the infant's neck. Means 15 preferably consisting of two pieces of VELCRO (trademark) can be provided at the end of the strap 13 and on the apron-like member 3 close to the other side of the neck of the infant, to fasten the straps 13 to the apron whenever it is necessary, thereby making it possible to detachably connect the apron-like member 3 to the neck of the infant to be fed.

In accordance with the invention, the apron-like member 3 is made of a flexible material, preferably a soft plastic material that can easily follow the shape of the infant torso and neck without hurting it.

The trough-shaped member 5 of the bib 1 is, in contrast, made of a rigid or substantially rigid material such as a rigid molded plastic material. This member 5 has an upper edge 17 which is substantially flat and rectilinear, and a lower edge 19 which si bent forwardly and upwardly to define a large trough T for catching solids and liquids dropped by the infant. Of course, the trough T is closed at both ends and can be reinforced by peripherical beads if necessary.

Figure 2:
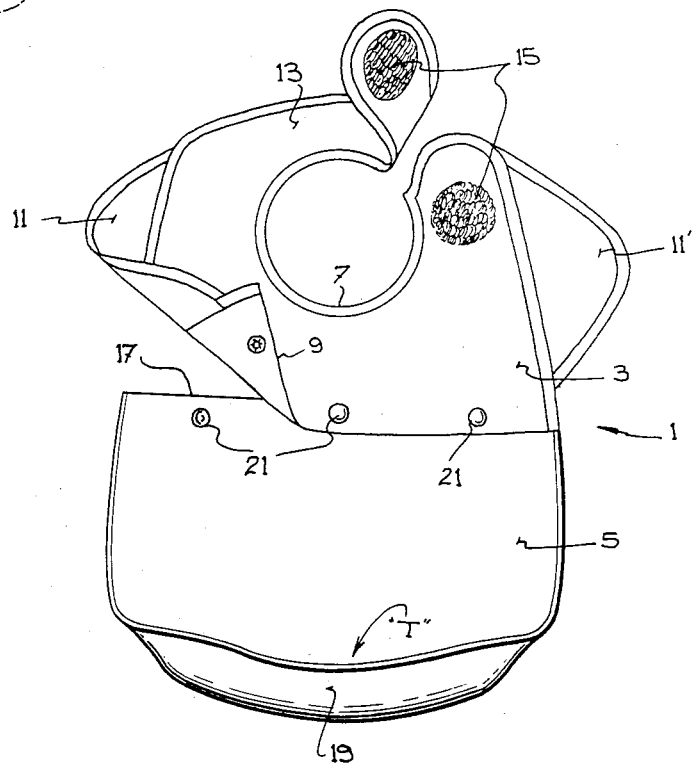
FIG. 2 is a front elevational view of the bib shown in FIG. 1, with one part of its apron-like member detached from its trough-shaped member.

Means 21 are provided for fixing the upper edge 17 of the trough-shaped member 5 to the lower edge 9 of the apron-like member 3 so that the rigid trough-shaped member 5 extends downwardly the flexible apron-like member 3 in cooperative relationship therewith as shown in FIGS. 1 and 2. The fixation means which are advantageously of the detachable type, may consist of snap-fasteners as shown in the accompanying drawings, or of any other means of similar nature, such as VELCRO-fasteners.

To give a nice aspect to the bib, the upper edge 17 of the trough-shaped member 5 is substantially of the same length as the lower edge 9 of the apron-like member 3 to which it is fixed. Similarly, the height of both members are respectively selected so that the entire height of the bib 1 be compatible with its intended use on an infant I.

The above description of the preferred embodiment of the invention must be considered as illustrative only of the principle of the invention. Indeed it may be easily understood that numerous modifications could be made by those skilled in the art without departing from the spirit of the invention as defined in the subsequent claims.

I claim:

1. An infant feeding bib comprising:

an apron-like member made of a flexible material, said apron-like member having an upper edge shaped to fit the neck of an infant to be fed, and a lower edge;

means on the upper end of the apron-like member for detachably connecting said apron-like member to the neck of the infant to be fed;

a trough-shaped member made of a rigid or substantially rigid material, said trough-shaped member having an upper edge which is substantially flat and a lower edge which is bent forwardly and upwardly to define a trough for catching solids and liquids dropped by the infant; and means for fixing the upper edge of the trough-shaped member to the lower edge of the apron-like member so that the trough-shaped member extends downwardly the flexible apron-like member in cooperative relationship therewith.

2. The infant bib of claim 1, wherein:

the upper edge of the trough-shaped member is substantially of the same length as the lower edge of the apron-like member to which it is fixed; and said means for fixing the upper edge of said trough-shaped member to the lower edge of said apron-like member are of the detachable type.

3. The infant bib of claim 2, wherein:

said means for detachably fixing the upper edge of the trough-shaped member to the lower edge of said apron-like member consists of a plurality of snap-fasteners.

4. The infant bib of claim 2, wherein:

said means for detachably fixing the upper edge of the trough-shaped member to the lower edge of said apron-like member consist of a VELCRO (T.M.) fastener.

5. The infant bib of claim 4, wherein:

said means for detachably connecting the apron-like member to the neck of the infant consist in a pair of knottable straps.

6. The infant bib of claim 4, wherein:

said means for detachably connecting the apron-like member to the neck of the infant consist in a strap fixed onto the apron-like member on one side of the neck of the infant, said strap being long enough to surround the infant's neck and being connectable to the other side of the neck of the infant with a fastener.

* * * * *